US009969586B2

(12) United States Patent
Malmqvist et al.

(10) Patent No.: US 9,969,586 B2
(45) Date of Patent: May 15, 2018

(54) REEL-UP AND A METHOD OF REELING A PAPER WEB IN THE DRY END OF A PAPER MACHINE

(71) Applicant: Valmet Aktiebolag, Sundsvall (SE)

(72) Inventors: Per-Olof Malmqvist, Karlstad (SE); Lars-Erik Oennerloev, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 382 days.

(21) Appl. No.: 14/771,663

(22) PCT Filed: Feb. 12, 2014

(86) PCT No.: PCT/SE2014/050170
§ 371 (c)(1),
(2) Date: Aug. 31, 2015

(87) PCT Pub. No.: WO2014/158071
PCT Pub. Date: Oct. 2, 2014

(65) Prior Publication Data

US 2016/0016745 A1 Jan. 21, 2016

(30) Foreign Application Priority Data

Mar. 27, 2013 (SE) ..... 1350395

(51) Int. Cl.
*B65H 18/22* (2006.01)
*B65H 18/02* (2006.01)
*B65H 20/06* (2006.01)

(52) U.S. Cl.
CPC ..... *B65H 18/22* (2013.01); *B65H 18/023* (2013.01); *B65H 20/06* (2013.01);
(Continued)

(58) Field of Classification Search
CPC ..... B65H 18/023; B65H 18/22; B65H 20/06; B65H 2601/211; B65H 2801/84
See application file for complete search history.

(56) References Cited

U.S. PATENT DOCUMENTS 3,743,199 A 7/1973 Karr et al.
4,420,529 A 12/1983 Westhead
(Continued)

FOREIGN PATENT DOCUMENTS

CN 1129023 A 8/1996
CN 1261856 A 8/2000
(Continued)

OTHER PUBLICATIONS

Machine Translation of FR 2 442 785 A1, Jun. 27, 1980. (Year: 1980).*
(Continued)

*Primary Examiner* — William E Dondero
(74) *Attorney, Agent, or Firm* — Alston & Bird LLP

(57) ABSTRACT

The invention relates to a reel-up 3 for receiving and winding into a roll 4 a paper web W that arrives from a drying cylinder 2 in a paper making machine and which drying cylinder 2 is located upstream of the reel-up 3 and which paper web W follows a path of travel from the drying cylinder 2 to the reel-up 3. The reel-up 3 comprises a rotatably mounted reel spool 5 onto which a paper web W can be wound to create a paper roll 4 of increasing diameter and an endless flexible belt 6 mounted for rotation along a predetermined path of travel such that the flexible belt 6 forms a loop. The flexible belt 6 is positioned adjacent to the reel spool 5 to engage the paper web W against the reel spool 5 during winding. The reel-up 3 is arranged to receive the paper web W at the end of a path of travel of the paper web W which ends in a point of contact P with the flexible belt 6 where the paper web W meets the flexible belt 6 such that a wedge-shaped space WS is formed between the flexible belt 6 and the paper web W. From the point of contact P, the paper web W will be carried by the flexible belt 6 to the reel-spool 5. According to the invention, the reel-up 3
(Continued)

further comprises an air deflector 8 for diverting or evacuating air away from the wedge-shaped space WS formed between the flexible belt 6 and the paper web W. The invention also relates to a method of reeling a paper web.

11 Claims, 6 Drawing Sheets

(52) U.S. Cl.
CPC ..... *B65H 2301/4143* (2013.01); *B65H 2601/211* (2013.01); *B65H 2801/84* (2013.01)

(56) References Cited

U.S. PATENT DOCUMENTS

| | | | | |
|---|---|---|---|---|
| 4,523,252 | A | 6/1985 | Wallen | |
| 4,649,074 | A | 3/1987 | Borel | |
| 5,014,924 | A | 5/1991 | Nowisch et al. | |
| 5,183,442 | A | 2/1993 | Lefferts | |
| 5,244,721 | A | 9/1993 | Wyche et al. | |
| 5,251,835 | A | 10/1993 | Kyytsonen | |
| 5,360,179 | A | 11/1994 | Vesterinen et al. | |
| 5,404,653 | A | 4/1995 | Skaugen et al. | |
| 5,514,456 | A | 5/1996 | Lefferts | |
| 5,531,396 | A | 7/1996 | Kinnunen et al. | |
| 5,738,760 | A | 4/1998 | Svanqvist et al. | |
| 5,782,426 | A | 7/1998 | Kinnunen et al. | |
| 5,901,918 | A | 5/1999 | Klerelid et al. | |
| 6,695,245 | B1 | 2/2004 | Schultz et al. | |
| 6,698,681 | B1 | 3/2004 | Guy et al. | |
| 6,743,334 | B2 | 6/2004 | Klerelid et al. | |
| 6,790,796 | B2 | 9/2004 | Smith et al. | |
| 6,797,115 | B2 | 9/2004 | Klerelid et al. | |
| 6,805,317 | B1 | 10/2004 | Andersson et al. | |
| 6,998,018 | B2 | 2/2006 | Klerelid et al. | |
| 7,112,258 | B2 | 9/2006 | Klerelid et al. | |
| 7,398,943 | B2 | 7/2008 | Horneck et al. | |
| 7,604,715 | B2 | 10/2009 | Liesén et al. | |
| 7,651,728 | B2 | 1/2010 | Payne et al. | |
| 7,896,034 | B2 | 3/2011 | Harwood et al. | |
| 8,167,229 | B2 | 5/2012 | Enwald et al. | |
| 8,871,060 | B2 | 10/2014 | Klerelid | |
| 2002/0139499 | A1 | 10/2002 | Berglund et al. | |
| 2003/0068948 | A1 | 4/2003 | Smith et al. | |
| 2003/0111199 | A1 | 6/2003 | Clarke et al. | |
| 2003/0164199 | A1 | 9/2003 | Levine et al. | |
| 2003/0221807 | A1 | 12/2003 | Klerelid et al. | |
| 2006/0076116 | A1 | 4/2006 | Klerelid et al. | |
| 2006/0124268 | A1 | 6/2006 | Billings | |
| 2006/0289692 | A1 | 12/2006 | Horneck et al. | |
| 2007/0003729 | A1 | 1/2007 | Harwood et al. | |
| 2007/0018028 | A1* | 1/2007 | Bianchini ..... | B65H 23/26 242/548.4 |
| 2007/0023561 | A1 | 2/2007 | Kemppainen et al. | |
| 2007/0075178 | A1 | 4/2007 | Hada et al. | |
| 2008/0050587 | A1 | 2/2008 | Billings | |
| 2008/0131652 | A1 | 6/2008 | Payne et al. | |
| 2008/0135195 | A1 | 6/2008 | Hermans et al. | |
| 2008/0318483 | A1 | 12/2008 | Salitsky et al. | |
| 2010/0051736 | A1 | 3/2010 | Enwald et al. | |
| 2010/0236656 | A1 | 9/2010 | Harwood et al. | |
| 2011/0146913 | A1 | 6/2011 | Harwood | |
| 2011/0151735 | A1 | 6/2011 | Harwood | |
| 2012/0024487 | A1 | 2/2012 | Quigley | |
| 2012/0024489 | A1 | 2/2012 | Quigley | |
| 2012/0267063 | A1 | 10/2012 | Klerelid et al. | |
| 2014/0130997 | A1 | 5/2014 | Klerelid | |
| 2016/0031667 | A1 | 2/2016 | Klerelid et al. | |
| 2016/0185548 | A1 | 6/2016 | Malmqvist | |
| 2016/0251187 | A1 | 9/2016 | Malmqvist | |

FOREIGN PATENT DOCUMENTS

| | | | | |
|---|---|---|---|---|
| CN | 1500058 | A | 5/2004 | |
| CN | 01578858 | A | 2/2005 | |
| CN | 101981252 | A | 2/2011 | |
| CN | 102121167 | A | 7/2011 | |
| CN | 102182097 | A | 9/2011 | |
| DE | 10305606 | A1 | 8/2004 | |
| DE | 102007055761 | A1 | 6/2009 | |
| EP | 0658504 | A2 | 6/1995 | |
| EP | 1538259 | A2 | 6/2005 | |
| EP | 1741648 | A2 | 1/2007 | |
| EP | 2354299 | A1 | 8/2011 | |
| FR | 2442785 | A1 * | 6/1980 | ..... B65H 18/26 |
| GB | 2423998 | A | 9/2006 | |
| JP | 3-195655 | A | 8/1991 | |
| JP | 7-206236 | A | 8/1995 | |
| JP | 2001225336 | A | 8/2001 | |
| JP | 2004-331360 | A | 11/2004 | |
| JP | 2005-535791 | A | 11/2005 | |
| KR | 1266781 | B1 | 5/2013 | |
| WO | WO 1997/048632 | A1 | 12/1997 | |
| WO | WO 1999/001363 | A1 | 1/1999 | |
| WO | WO 2003/031711 | A1 | 4/2003 | |
| WO | WO 2008/125723 | A1 | 10/2008 | |
| WO | WO 2008/154214 | A1 | 12/2008 | |
| WO | WO 2008/157223 | A1 | 12/2008 | |
| WO | WO 2009/118450 | A1 | 10/2009 | |
| WO | WO 2013/113110 | A1 | 8/2013 | |
| WO | WO 2014/175808 | A1 | 10/2014 | |
| WO | WO 2015/034413 | A1 | 3/2015 | |

OTHER PUBLICATIONS

International Searching Authority, International Search Report and Written Opinion for International Application No. PCT/SE2014/050170, dated Jun. 26, 2014, 9 pages, Swedish Patent and Registration Office, Stockholm.

State Intellectual Property Office of the P.R.C., First Notification of Office Action for Application No. 201480018860.6, dated Apr. 6, 2016, 10 pages, China.

Japan Patent Office, Notice of Reason for Rejection for Application No. 2016-505434, dated Jul. 7, 2017, 10 pages, Japan.

* cited by examiner

REEL-UP AND A METHOD OF REELING A PAPER WEB IN THE DRY END OF A PAPER MACHINE

CROSS REFERENCE TO RELATED APPLICATIONS

This application is a national stage application, filed under 35 U.S.C. § 371, of International Application No. PCT/SE2014/050170, filed Feb. 12, 2014, which claims priority to Swedish Patent Application No. 1350395-8, filed Mar. 27, 2013, the contents of both of which as are hereby incorporated by reference in their entirety.

BACKGROUND

Technical Field

The present invention relates to a reel-up in the dry end of a paper making machine and to a method of reeling a paper web in the dry end of a paper making machine.

Description of Related Art

In the dry end of a paper making machine, the dried paper web is wound on reel spools into parent rolls in a reel-up. In U.S. Pat. No. 5,901,918, a reel-up is disclosed in which the reel spool is engaged by an endless flexible member such as a transfer belt. The paper web is transferred from the endless flexible member to the parent roll as the parent roll is urged against the paper web as the paper web is supported by the endless flexible member. Before the paper web can be wound on the reel spool, it must travel from the dryer to a point where it can be transferred to the endless flexible member. The reel-up disclosed in U.S. Pat. No. 5,901,918 includes an embodiment in which the dried paper web is first transferred to a dry end transfer fabric which transfers the paper web to the endless flexible member. When the paper web reaches the endless flexible member, the web will then be sandwiched between the transfer fabric and the endless flexible member. The reel-up disclosed in U.S. Pat. No. 5,901,918 functions well. However, in many practical embodiments, it is preferred that the paper web be passed along a path that ends with an open draw. In such embodiments, it has been discovered that the paper web may become unstable and flutter on the endless flexible member. Therefore, it is an object of the present invention to counteract such instability and flutter.

BRIEF SUMMARY

The invention relates to a reel-up in the dry end of a paper making machine. The inventive reel-up is designed and arranged for receiving and winding into a roll a paper web that arrives from a drying cylinder in a paper making machine and which drying cylinder is located upstream of the reel-up. The paper web will thus follow a path of travel from the drying cylinder to the reel-up. The reel-up comprises a rotatably mounted reel spool onto which a web of paper can be wound to create a paper roll of increasing diameter and an endless flexible belt mounted for rotation along a predetermined path of travel such that the flexible belt forms a loop. The flexible belt is positioned adjacent to the reel spool to engage the web against the reel spool during winding. The reel-up is arranged to receive the paper web at the end of a path of travel of the paper web which ends in a point of contact with the flexible belt where the web meets the flexible belt such that a wedge-shaped space is formed between the flexible belt and the paper web. In many embodiments of the invention, the path of travel includes an open draw. The inventive reel-up is primarily (but not necessarily) intended to be placed to receive the paper web from a path of travel of the paper web that includes and ends with an open draw which open draw ends in the point of contact with the flexible belt such that the point of contact is located at the end of the open draw. From the point of contact the paper web will be carried by the flexible belt to the reel-spool. According to the invention, the reel-up further comprises an air deflector in the area immediately before the point of contact which is capable of diverting flows of air entrained by the paper web and/or the flexible belt away from the wedge-shaped space formed between the flexible belt and the paper web.

The air that is diverted is mainly boundary layer air that is entrained by the paper web and/or the flexible belt.

The air deflector may be shaped as a beam which extends in a cross machine direction and has a substantially triangular cross section.

The air deflector may optionally be arranged to be movable between a first position away from the point of contact in which first position the air deflector does not affect air entrained by the paper web and a second position in which second position the air deflector is so close to the point of contact that the boundary layer air entrained by flexible belt and/or the paper web will be diverted away from the wedge-shaped space.

In embodiments of the invention, the air deflector may also comprise at least one blade which can be adjusted in relation to the air deflector when the air deflector is in its second position such that the blade can be brought closer to the flexible belt or the paper web.

In such embodiments of the invention in which the flexible belt is air permeable, the reel-up may also comprise a suction roll which is located at the point of contact where the paper web meets the flexible belt, the suction roll having a suction zone that acts both upstream and downstream of the point of contact. The suction roll may then contribute to the removal of boundary layer air by evacuating air away from the wedge-shaped space formed between the flexible belt and the paper web In such embodiments of the invention in which the flexible belt is air permeable, at least one blow box may optionally be arranged inside the loop of the flexible belt between the point of contact and the reel spool such that an underpressure can be generated that draws the paper web against the flexible belt.

The flexible belt may be guided in its loop by guide rolls inside the loop of the flexible belt. The reel spool may then be arranged to engage the web at a point between a guide roll located upstream of the reel spool and a guide roll located downstream of the guide roll. In embodiments using a flexible belt which is air permeable, the upstream guide roll may then be a suction roll which is partially wrapped by the flexible belt.

The invention also relates to a method of reeling a paper web on the inventive reel-up. In the inventive method, air is diverted or from the wedge-shaped space formed between the flexible belt and the paper web.

DETAILED DESCRIPTION OF VARIOUS EMBODIMENTS

Figure 1:
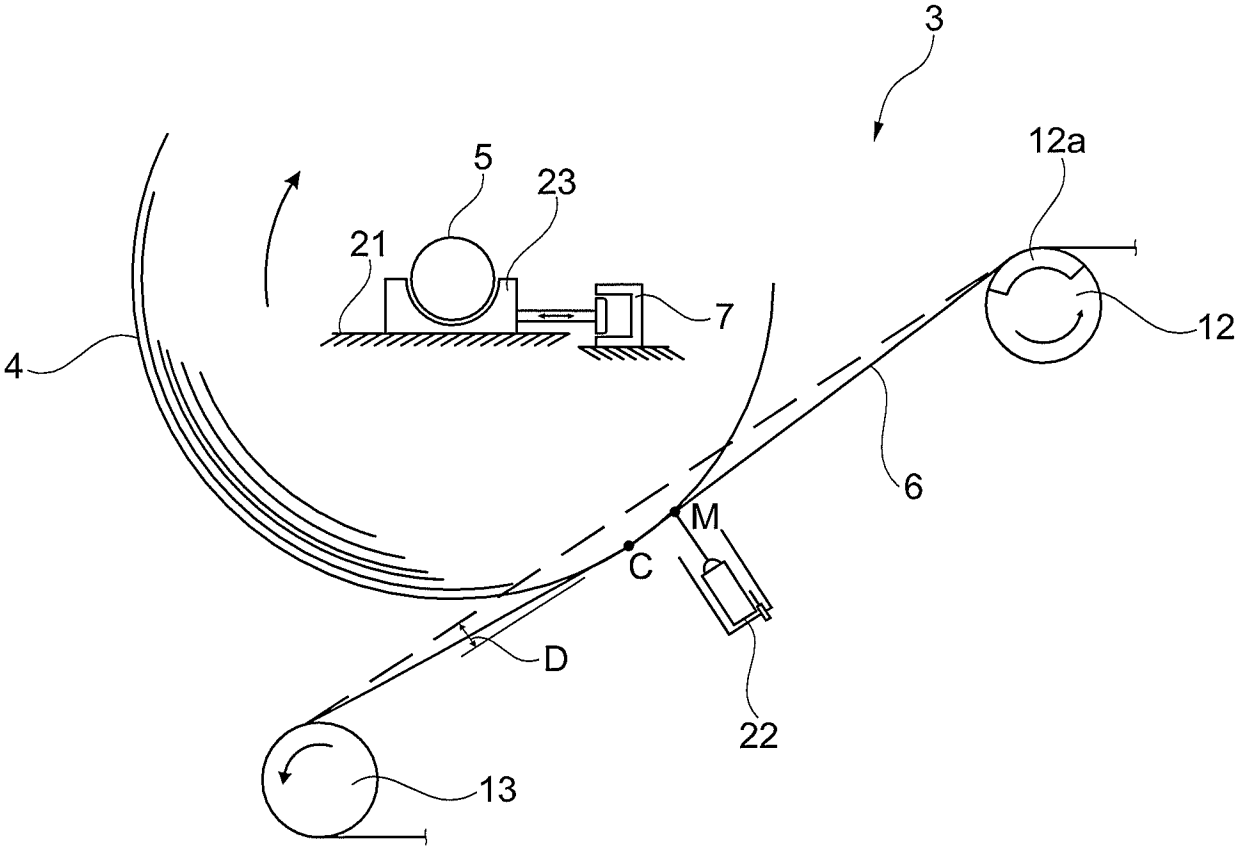
FIG. 1 is a schematic side view of a part of a reel-up according to the present invention.

With reference to FIG. 1, a reel-up 3 is shown which functions in the way disclosed in U.S. Pat. No. 5,901,918. A paper web is carried by a flexible belt 6 to a nip point C where the flexible belt 6 engages the web against a reel spool 5 during winding as the paper web is wound to a paper roll 4. Of course, once the web has started to become wound on the reel spool 5 and form a paper roll 4 on the reel spool, new paper web that arrives will be engaged against the reel spool 5 through the paper roll 4 that is being formed on the reel spool. In the context of this patent application and any patent granted on this patent application, the expression "engage the web against the reel spool" should thus be understood as including the case where the web that arrives to the nip point C is engaged by the flexible belt 6 against the paper roll 4 that is wound on the reel spool 5. In FIG. 1, it is schematically indicated how the reel spool 5 may rest in a carriage 23. Although not visible in FIG. 1, it should be understood that each axial end of a reel spool 5 is suitably supported in such a carriage 23. During winding, the diameter of the paper roll 4 will increase. As a consequence thereof, the flexible belt 6 will be deflected away from its original path. In FIG. 1, the amount of deflection is indicated by the reference sign D. As disclosed in U.S. Pat. No. 5,901,918, a sensing device 22 is arranged to measure the deflection D (the deflection D does not necessarily need to be measured at the nip point C). The sensing device 22 may be, for example, a laser sensor for sensing distance. The deflection D is detected by the sensing device 22. The detected deflection D causes the sensing device 22 to generate a signal in response to the size of the detected deflection D. The signal generated by the sensing device 22 is sent to a logic controller (not shown) which may be, for example, a computer. The logic controller is connected to an actuator 7 which is arranged to act on the carriage 23 in which the reel spool is supported. Suitably, such an actuator 7 may be arranged to act on a carriage 23 at each axial end of the reel spool 5 and each such actuator 7 may be in connection with the logic controller. The logic controller is programmed to keep the deflection D substantially constant. When the logic controller receives a signal from the sensing device 22 which indicates that the deflection D increases, the logic controller causes the actuator or actuators 7 to act on the carriage or carriages 23 such that the carriage or carriages 23 move(s) away from the flexible belt 6. Thereby, the paper roll 4 will also move away from the flexible belt 6 such that the deflection D can be kept constant. Thereby, the pressure in the nip point C can be kept substantially constant such that the winding process can be carried out in a uniform and even way. It should be understood that the carriage or carriages 23 may be arranged to move on rails 21 such that the actuator or actuators 7 cause(s) the carriage(s) to glide along the rails 21 (see FIG. 2). It can be added that, in FIG. 1, the deflection D is not necessarily measured (detected) at the nip point C. Instead, it can be measured at a point M which is slightly upstream of the nip point C. However, the measurement can also be made at the actual nip point C or slightly after the nip point C. The design of the reel-up shown in FIG. 3 of U.S. Pat. No. 5,901,918 may be used in the present invention.

Figure 2:
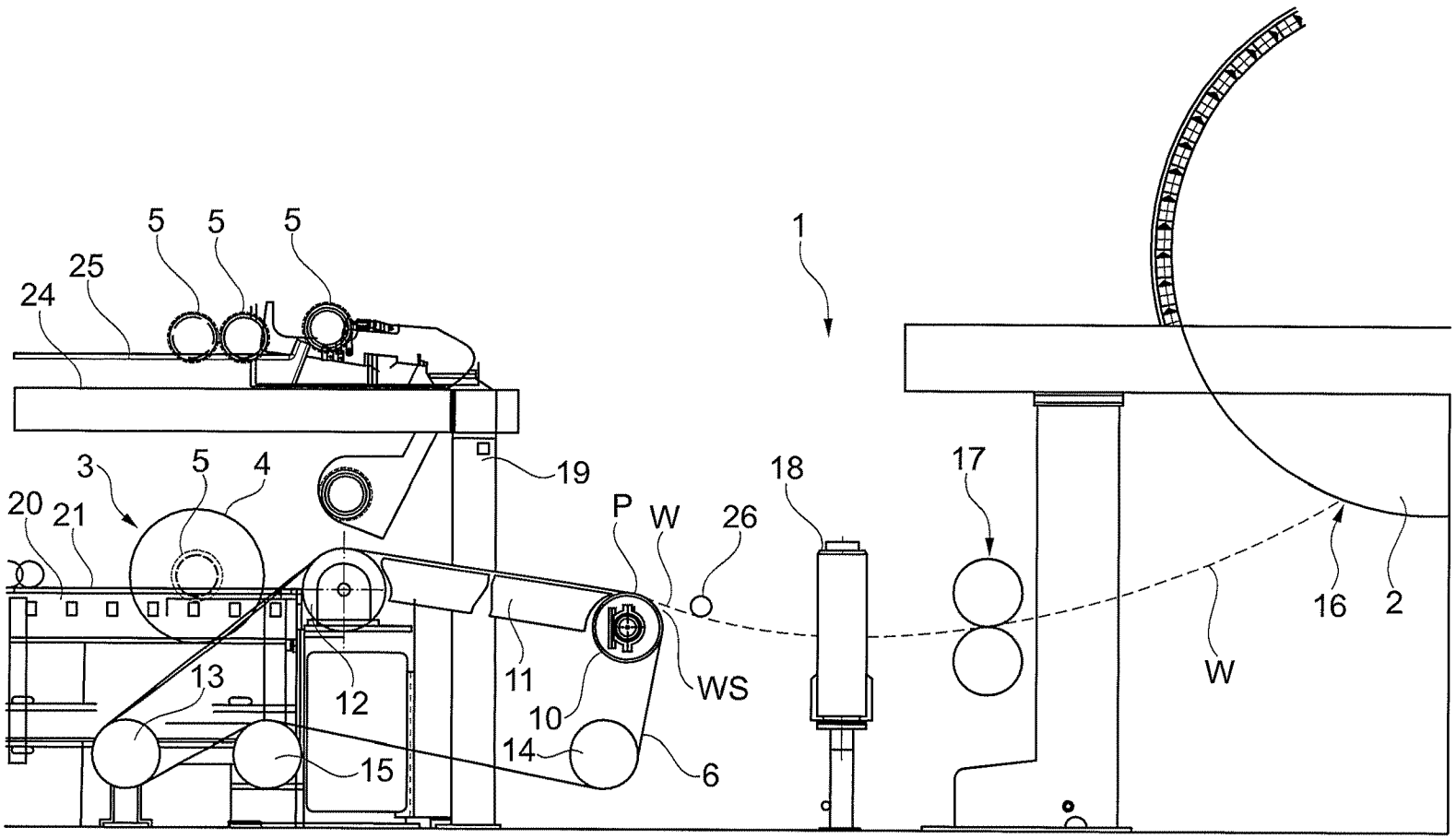
FIG. 2 is a side view of a reel-up placed in the dry end of a paper making machine but lacking the inventive features of the present invention.

Reference will now be made to FIG. 2 which shows how a reel-up of the kind shown in FIG. 1 can be arranged in a papermaking machine. FIG. 2 shows an embodiment of a dry end 1 of a paper making machine, in particular a machine for making tissue paper. The reel-up 3 is arranged and designed for receiving and winding into a roll 4 a paper web W that arrives from a drying cylinder 2 in the paper making machine. The drying cylinder 2 is arranged upstream of the reel-up 3 and the paper web W is intended to follow a path of travel from the drying cylinder 2 to the reel-up 3. The drying cylinder 2 may be a Yankee drying cylinder that is heated from the inside by hot steam. A doctor blade 16 is arranged to crepe the paper web W from the surface of the drying cylinder 2 such that the paper web W can be sent to the reel-up 3 along its path of travel. On its path to the reel-up, the paper web W may optionally be supported along at least a part of the path of travel by a web support. An example of a web support suitable for using between a drying cylinder 2 and a reel-up 3 is disclosed in U.S. Pat. No. 5,738,760 and other web supports are also possible. Web supports are also known in which the paper web may be supported by a belt that functions as a transfer fabric. Where no support for the paper web W is used, the paper web W must pass an open draw (an unsupported part of its path of travel). Although no web support is shown in FIG. 2, it should be understood that a web support may be used for at least a part of the path of travel of the paper web W. However, it may sometimes be difficult to use web supports because other equipment may block the space in which such a web support would be placed. For example, there may be calenders or measuring equipment along the path of travel of the paper web W. In the embodiment of FIG. 2, the paper web W passes through a calender 17 with two rolls that form a calendering nip through which the paper web W may pass. The calender 17 may improve surface properties of the paper web but it should be understood that the calender 17 is optional. In addition to a calender 17, a measuring unit 18 may be arranged to measure such properties as, for example, basis weight and/or dry solids content of the paper web W.

As explained with reference to FIG. 1, the reel-up 3 comprises a rotatably mounted reel spool 5 onto which a paper web W can be wound to create a paper roll 4 of increasing diameter and an endless flexible belt 6 mounted for rotation along a predetermined path of travel such that the flexible belt 6 forms a loop. As previously explained with reference to FIG. 1, the flexible belt 6 is positioned adjacent to the reel spool 5 to engage the paper web W against the reel spool 5 during winding.

As can be seen in FIG. 2, the reel-up 3 may optionally include a stand supported by vertical or substantially vertical pillars 19. The pillars 19 may support parallel horizontal lower beams 20 that carry the rails 21 on which that carriages 23 of the reel spools 5 may be moved. When a paper roll 4 has been completed, it will be transported along the rails 21 away from the flexible belt 6. The pillars 19 may also support upper horizontal beams 24 that carry rails 25 along which new empty reel spools 5 may be supported. The upper rails 25 may thus serve as storage for new reel spools 5. Whenever a new paper roll 4 has been completely wound on its reel spool 5, a new empty reel spool 5 may be taken from the upper rails 5 and placed in a position where the paper web W can be wound onto the new reel spool 5 to form a new paper roll 4. The procedure of taking a new reel spool 5 from storage and bringing it into position is known as such and will not be further described here.

Figure 3:
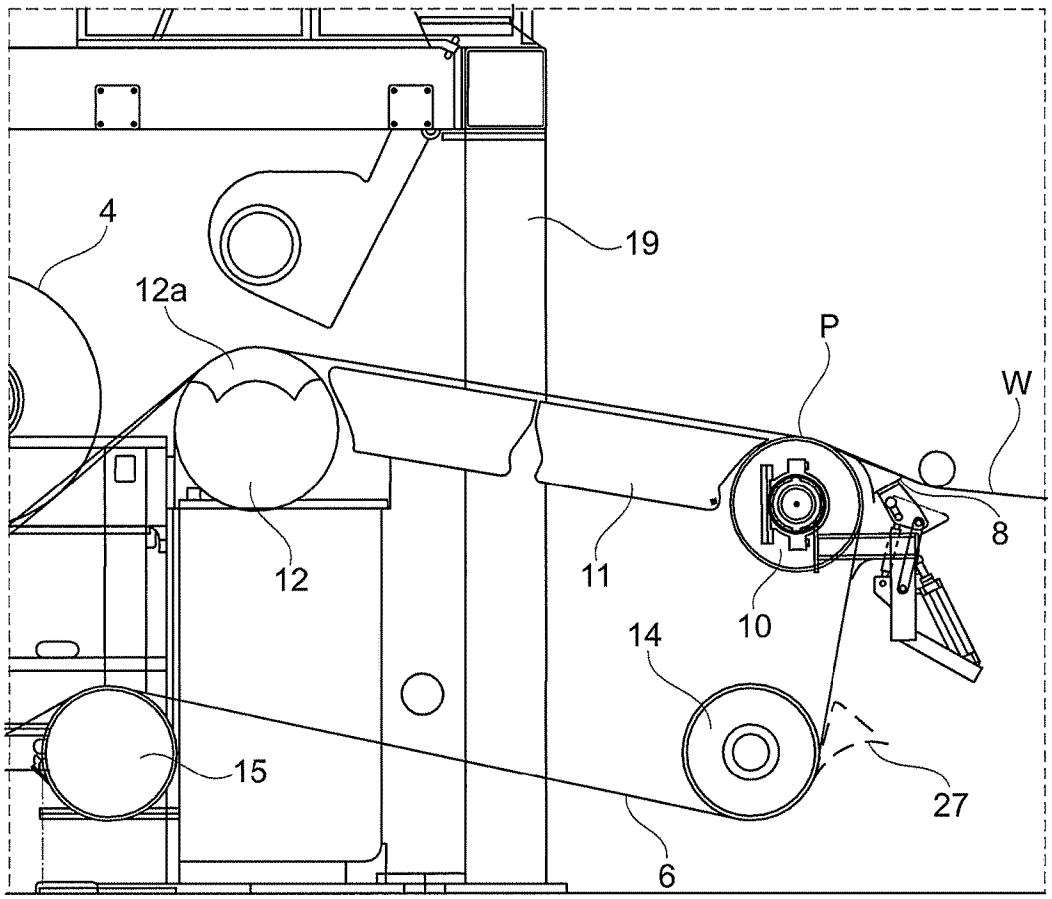
FIG. 3 is a side view similar to FIG. 2 but in a larger scale than FIG. 2 and showing a reel-up according to an embodiment of the present invention.
Figure 6:
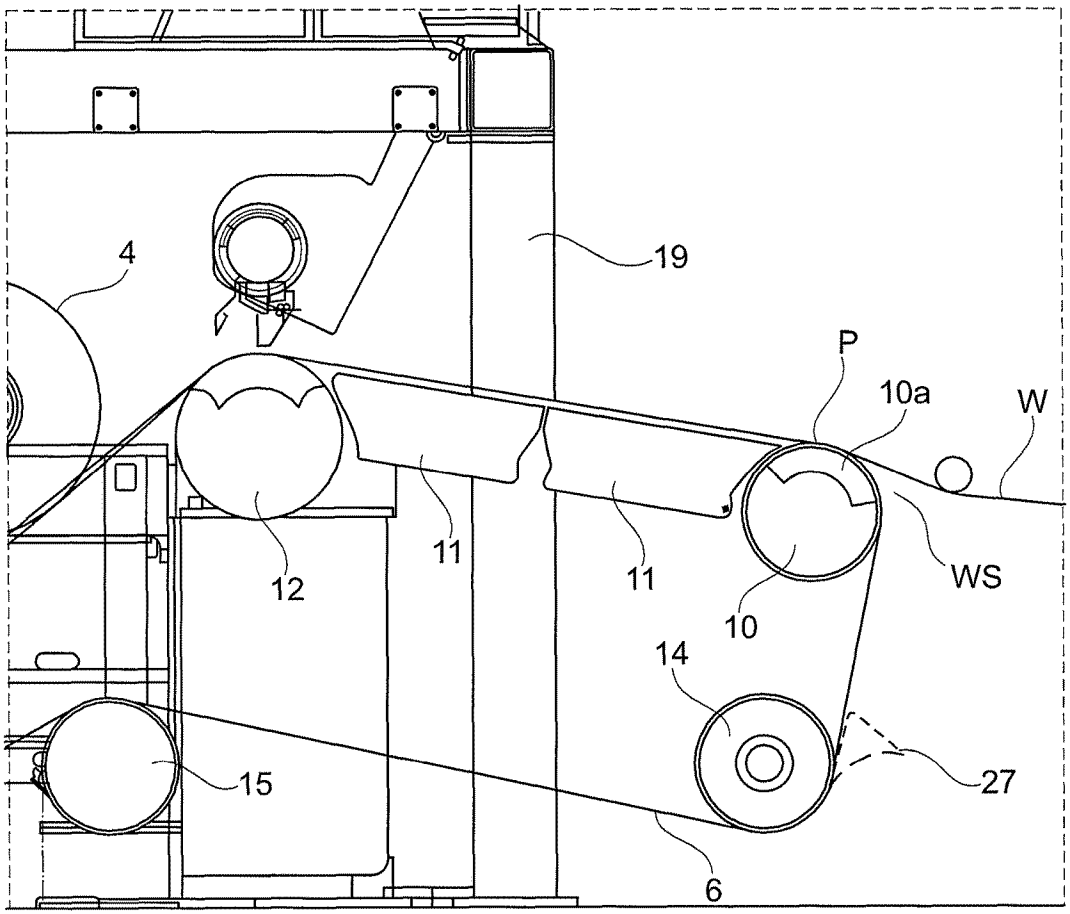
FIG. 6 is a view similar to FIG. 3 but illustrating an embodiment which additionally uses a suction roll for additional removal of boundary layer air.

As best seen in FIG. 2 FIG. 3 and FIG. 6, the reel-up 3 is arranged to receive the paper web W at the end of the path of travel of the paper web W. The path of travel of the paper web W ends in a point of contact P with the flexible belt 6 where the paper web W meets the flexible belt 6. From the point of contact P, the paper web W will be carried by the flexible belt 6 to the reel-spool 5. When the paper web W meets the flexible belt 6 in this way, a wedge-shaped space WS is formed between the flexible belt 6 and the paper web W. As the paper web W moves towards the point of contact P, it will inevitably have a boundary layer of air that will be carried into the wedge-shaped space WS. In the same way, the flexible belt 6 will also have a boundary layer of air that will be carried into the wedge-shaped space WS. When air flows into the wedge-shaped space WS, this can lead to a build-up of pressure in the wedge-shaped space WS and air can be forced in between the flexible belt 6 and the paper web after the point of contact P which may cause the paper web W to flutter. Flutter of the paper web W may lead to web breaks and other undesirable problems. For example, air that flows into the gap WS may cause web movement in the cross machine direction (the CD direction) and such movement in the cross machine direction may disturb the reeling process. Therefore, air flows into the wedge-shaped gap WS should be counteracted.

The problem with air that is entrained by the paper web W and/or the flexible belt 6 becomes greater if the paper web is unsupported at the end of its path of travel. If the paper web W is carried to the point of contact P on the lower side of a transfer fabric, the transfer fabric could contribute to reduce tendencies to flutter. However, it may often be difficult to find space for such web support devices. Therefore, the path of travel of the paper web W normally ends with an open draw such that the paper web is unsupported. The path of travel of the paper web top the reel-up 3 thus includes an open draw and the open draw is located at the end of the path of travel such that the point of contact P with the flexible belt 6 is located at the end of the open draw. Under such circumstances, the risk of web flutter becomes greater. Moreover, flows of air (i.e. boundary layer air) that become entrained into the wedge-shaped space WS may actually cause at least some disturbances even if the paper web W is supported all the way to the point of contact and even if a transfer fabric is used (even if a transfer fabric would at least reduce the problem to a considerable extent). In the embodiment of FIG. 2, a guide roll 26 may be arranged upstream of the contact point P to guide the paper web W towards the contact point P.

To counteract flutter of the paper web W, the inventors has found that the boundary layer of air that is entrained by the paper web W and/or the flexible belt 6 should be diverted from the wedge-shaped space WS before it reaches the wedge-shaped space WS. Therefore, the inventive reel-up 3 is provided with means for diverting air away from the wedge-shaped space WS formed between the paper web W and the flexible belt 6.

Figure 4:
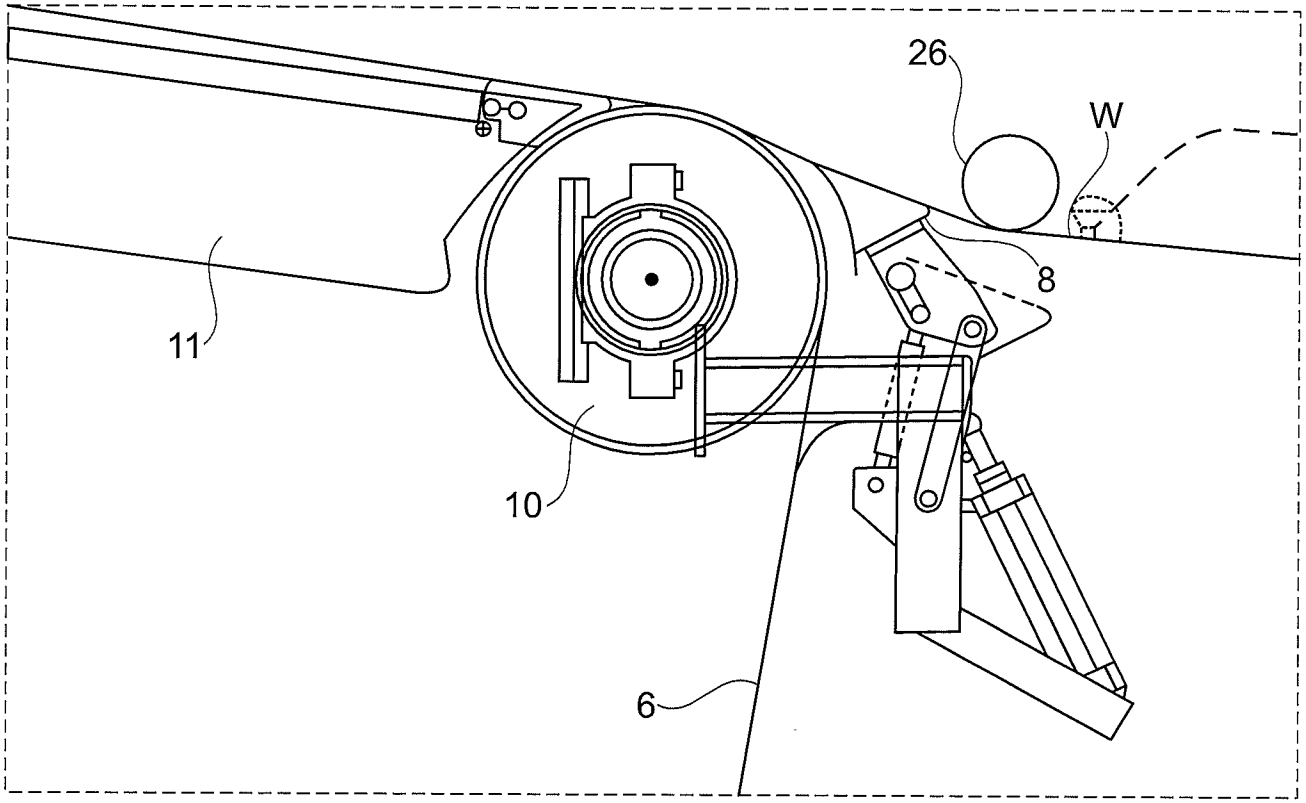
FIG. 4 is a view similar to FIG. 3 but showing a detail in even larger scale.

Reference will now be made to FIG. 3 and to FIG. 4. Unlike the reel-up of FIG. 2, the reel-up 3 which is shown in FIG. 3 and in FIG. 4 is provided with air deflector 8 in the area immediately before the point of contact P. The air deflector 8 is capable of diverting flows of air entrained by the paper web W and/or the flexible belt 6 (i.e. boundary layer air entrained by the paper web W and/or the flexible belt 6) away from the wedge-shaped space WS.

The air deflector 8 may advantageously be shaped as a beam which extends in the cross machine direction. The beam has a cross section which is preferably substantially triangular. With such a shape, a pointed end of the air deflector 8 may extend further into the wedge-shaped space WS and the shape of the air deflector 8 may be substantially similar to the shape of the wedge-shaped space WS. When air entrained by the paper web W and/or the flexible belt 6 reaches the air deflector 8, the air deflector 8 will prevent at least a part of the entrained air from entering the wedge-shaped space WS and cause disturbances.

Figure 5:
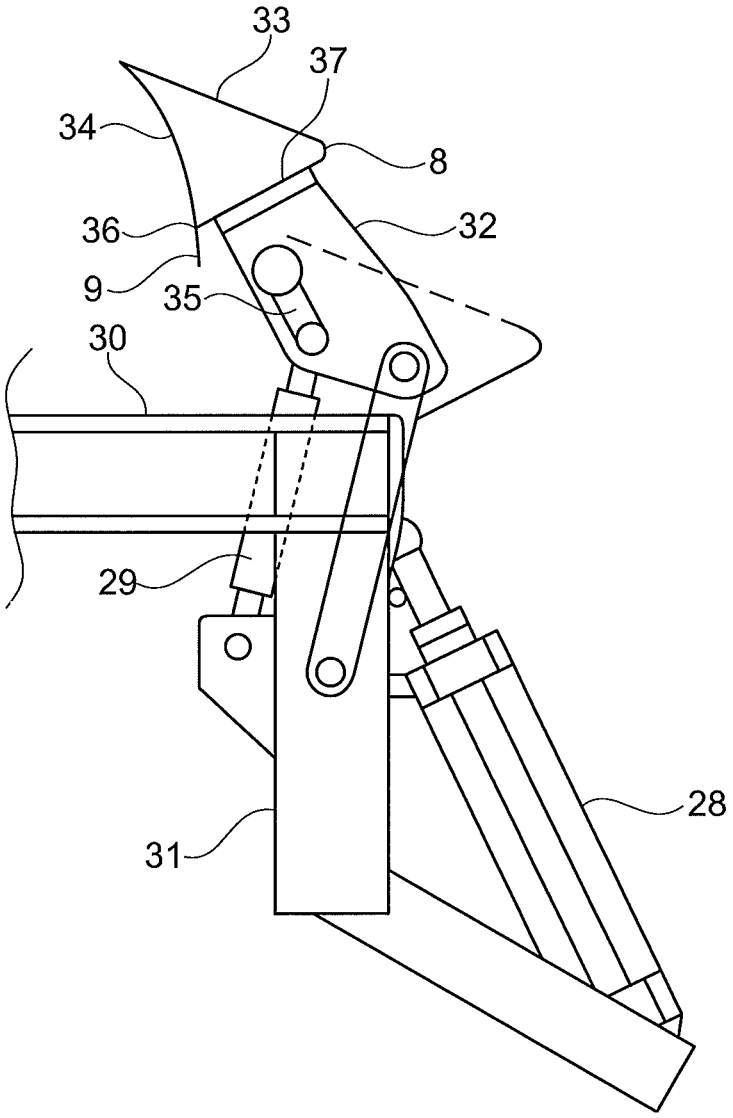
FIG. 5 shows, in larger scale, one of the components in FIG. 4.

Preferably, the air deflector 8 is arranged to be movable between a first position away from the point of contact P in which first position the air deflector 8 does not affect air entrained by the paper web W or the flexible belt 6 and a second position in which second position in which the air deflector 8 is so close to the point of contact P that flows of air entrained by the flexible belt 6 and/or the paper web W (boundary layer air) will be diverted away from the wedge-shaped space WS. In FIG. 5, the air deflector 8 is shown in isolation from the paper web W and the flexible belt 6. In the embodiment shown in FIG. 5, the air deflector 8 is carried on a holder 32 and the holder 32 may be held by one or several link arms 31 that can be acted upon by one or several actuators 28, 29. The actuators 28, 29 may be, for example, hydraulic or pneumatic cylinders. The link arms 31 and actuators 28, 29 that hold the air deflector 8 and are thus arranged to cause the air deflector 8 to move between the first position and the second position of the air deflector.

As can be seen in FIG. 4, the air deflector 8 is arranged such that it can act in the wedge-shaped space WS, i.e. adjacent to both the flexible belt 6 and the web W and it is placed on the same side of the paper web W as the flexible belt 6.

It should be understood that embodiments in which the air deflector 8 is in a fixed position are also possible. In such embodiments, the air deflector 8 would not be movable but would be permanently placed in a position where it can divert flows of air entrained by the paper web W and/or the flexible belt 6.

In the embodiment of FIG. 5, the link arms 31 and the actuators 28, 29 are carried by a beam 30 that is preferably fixed. A slot 35 in the holder 32 provides a guide for an upper part of an actuator 29. The skilled person can easily think of many different ways in which the air deflector 8 can be arranged to be movable in and out of the wedge-shaped space WS and the link arms 31 and actuators 28, 29 that are indicated in FIG. 5 only represent one solution. It should be understood that, in most realistic embodiments, there can be a holder 32 for the air deflector 8 at each axial end of the air deflector 8. The air deflector 8 extends substantially in the cross machine direction such that the axial ends of the air deflector 8 are located at different sides of the machine. In the same way, link arms 31 and actuators 28, 29 are preferably arranged at opposite axial ends of the air deflector 8.

As best seen in FIG. 5, the air deflector 8 may be shaped as a beam with a triangular cross section. A first wall part 33 of the air deflector 8 is arranged to be facing the paper web W during operation while a second wall part 34 of the air deflector is arranged to be facing the flexible belt 6 during operation. A third wall part 37 may be arranged to connect the first wall part 33 to the second wall part 34.

As can be seen in FIG. 5, the air deflector 8 may carry at least one blade 9 which can be adjusted in relation to the air deflector 8 when the air deflector 8 is in its second position such that the blade 9 can be brought closer to the flexible belt 6 or the paper web W. For example, the blade 9 may be arranged such that it is connected by a hinge at a point 36 on the air deflector 8. The blade 9 can be swung towards the flexible belt 6 and locked in different positions such that the distance between the blade 9 and the flexible belt 6 decreases. Thereby, the air deflector 8 will be even more effective in diverting air entrained by the flexible belt 6 away from the wedge-shaped space WS. It should be understood that the at least one blade 9 need not be arranged to be pivoted but could instead be carried by the air deflector 8 in such a way that its position can be adjusted in a linear movement. It should also be understood that such a blade could also be arranged to be brought closer to the paper web W.

Reference will now be made to FIG. 6. In addition to using the air deflector described above with reference to FIGS. 3-5, the reel-up may also comprise a suction roll 10 which is located inside the loop of the flexible belt 6 at the point of contact P where the paper web meets the flexible belt. In such embodiments, the suction roll 10 has a suction zone 10*a* that acts both upstream and downstream of the point of contact P. The suction zone 10*a* of the suction roll 10 sucks air away from the wedge-shaped space WS such that air is evacuated from the wedge-shaped space WS. This solution requires that the flexible belt 6 be air permeable. Therefore, an air permeable flexible belt 6 is used. The air deflector 8 is not showed in FIG. 6 but this is only because FIG. 6 is focused on the use of a suction roll 10. It should be understood that the suction roll of FIG. 6 is used in combination with the air deflector. It should also be understood that the flexible belt 6 may be air permeable also in embodiments where no suction roll is used to evacuate air from the wedge-shaped space WS. In embodiments in which no suction roll is used to evacuate air from the wedge-shaped space WS, the flexible belt 6 may be permeable to air or impermeable to air.

The air deflector 8 is then combined with a suction roll 10 that sucks air away from the wedge-shaped space. When both the air deflector 8 and the suction roll 10 are used in combination, the result may be even better.

In advantageous embodiments of the inventions, the reel-up 3 may optionally be provided with at least one blow box 11 is arranged inside the loop of the flexible belt 6 between the point of contact P and the reel spool 5 such that an underpressure can be generated that draws the paper web W against the flexible belt 6. This further reduces the risk of flutter of the paper web W downstream of the point of contact P. As an alternative to a blow box 11, some other device for generating an underpressure may be used. The use of such a blow box 11 requires that the flexible belt 6 be air permeable. Several blow boxes 11 that follow each other may be used.

As best seen in FIG. 3 and FIG. 6, a further air deflector 27 may optionally be arranged adjacent the flexible belt 6 at a point away from the wedge-shaped space WS. The purpose of the further air deflector 27 is not only to prevent air from being transported into the wedge-shaped space WS. Instead, the main purpose of the additional air deflector 27 is to create a flow of air away from the flexible belt 6 such that dust in the air is transported away from the immediate vicinity of the flexible belt 6. The additional air deflector 27 is optional and embodiments without such an additional air deflector 27 are perfectly possible.

Reference is now again made to FIG. 1 and to FIG. 2. As can be seen in FIG. 1 and FIG. 2, the flexible belt 6 is guided in its loop by guide rolls 10, 12, 13, 14 inside the loop of the flexible belt 6. Optionally, one or several guide rolls 15 may also be arranged outside the loop of the flexible belt 6. As can be seen in FIG. 1, the reel spool 5 (and thereby also the paper roll 4 that is being wound on the reel spool 5) is arranged to engage the paper web W at a point between a guide roll 12 which is located upstream of the reel spool 5 and a guide roll 13 that is located downstream of the guide roll. In advantageous embodiments of the invention, the upstream guide roll 12 is a suction roll which is partially wrapped by the flexible belt. In FIG. 1, the reference numeral 12*a* refers to the suction zone of the guide roll 12. The use of a suction roll 12 in this position improves adherence of the paper web W to the flexible belt and reduces the risk of web flutter. It should be understood that the upstream guide roll 12 is not necessarily a suction roll; it can also be a solid roll. Embodiments are also conceivable in which the roll 12 has a suction zone only at one of its axial ends. Such a suction zone which is located at an axial end of the roll 12 could be used for threading.

It will now be appreciated that he inventive reel-up described above corresponds to a method in which the paper web W is wound onto the reel spool 5 and transported to the reel spool 5 on the flexible belt 5 while air is diverted away from the wedge-shaped space WS formed between the flexible belt 6 and the paper web W by the air deflector 8 or by a combination of an air deflector 8 and a suction roll 10 located inside the loop of the flexible belt 6 at the point of contact P and wherein the suction zone 10*a* of the suction roll 10 acts both upstream of and downstream of the point of contact P.

The inventive method may include the step of moving the air deflector 8 from a first position away from the point of contact P to a second position in which the air deflector 8 is so close to the point of contact P that flows of air entrained by the flexible belt 6 and/or the paper web W will be diverted away from the wedge-shaped space WS.

In embodiments of the invention, the air deflector 8 may be connected to a source of pressurized air and the air deflector 8 may have openings through which air may be blown from the deflector in a direction parallel with the direction of movement of the paper web W and/or the flexible belt 6. In such embodiments, air should preferably be blown in a direction which is opposite to the direction of movement of the paper web W and/or the flexible belt 6. In such embodiments, the air blown from the air deflector 8 may cause an underpressure in the area between the paper web W and the air deflector 8 and/or in the area between the air deflector 8 and the flexible belt 6. Thereby, the paper web W and/or the flexible belt 6 will be sucked towards the air deflector 8 and boundary layers of air will be further prevented from following the paper web W and/or the flexible belt 6 into the wedge-shaped space WS.

Although the invention has been described above in terms of a reel-up and a method, it should be understood that these categories only reflect different aspects of one and the same invention and that the method may include such steps that would be the inevitable consequence of using the inventive reel-up, regardless of whether such steps have been explicitly mentioned or not.

Thanks to the inventive reel-up and the inventive method, flutter of the paper web W on the flexible belt 6 of the reel-up 3 can be reduced or eliminated.

While the invention has been described above with reference to a machine that uses a Yankee drying cylinder 2, it should be understood that the inventive machine and the inventive method could also be used on a paper making machine that uses other drying units, for example a TAD-cylinder. The invention is particularly suitable for tissue paper machines but could be used also in other paper making machines.

Although the invention has been defined above in terms of a reel-up 3, the invention could also be defined in wider terms as an entire dry end of a paper making machine. The inventive dry end may then include both the drying cylinder 2 and the reel-up 3 which is located downstream of the drying cylinder such that, during operation, a paper web will travel from the drying cylinder to the reel-up along a path that includes an open draw which open draw ends in a point of contact with the flexible belt where the web meets the flexible belt such that a wedge-shaped space is formed between the flexible belt and the paper web and from which point of contact the paper web will be carried by the flexible belt to the reel-spool.

It should also be understood that the arrangement described with reference to FIG. 1 in which an actuator 7 for positioning the reel spool 5 and the flexible belt relative to each other may also be a part of the inventive reel-up, the inventive dry end 1 and the inventive method.

The invention claimed is:

1. A reel-up (3) for receiving and winding into a paper roll (4) a paper web (W) that arrives from a drying cylinder (2) in a paper making machine and which drying cylinder (2) is located upstream of the reel-up (3) and which the paper web (W) follows a path of travel from the drying cylinder (2) to the reel-up (3), the reel-up (3) comprising:

a rotatably mounted reel spool (5) onto which the paper web (W) can be wound to create the paper roll (4) of increasing diameter;

an endless flexible belt (6) mounted for rotation along a predetermined path of travel such that the flexible belt (6) forms a loop, the flexible belt (6) being positioned adjacent to the reel spool (5) to engage the paper web (W) against the reel spool (5) during winding; and an air deflector (8), wherein:

the reel-up (3) is configured to receive the paper web (W) at the end of the path of travel of the paper web (W) which ends in a point of contact (P) with the flexible belt (6) where the paper web (W) meets the flexible belt (6) such that a wedge-shaped space (WS) is formed between the flexible belt (6) and the paper web (W) and from which point of contact (P) the paper web (W) will be carried by the flexible belt (6) to the reel-spool (5), the air deflector (8) is positioned in the area immediately before the point of contact (P); and the air deflector (8) is configured to divert flows of air entrained by at least one of the paper web (W) or the flexible belt (6) away from the wedge-shaped space (WS).

2. A reel-up (3) according to claim 1, wherein the air deflector (8) is shaped as a beam, which extends in the cross machine direction.

3. A reel-up (3) according to claim 2, wherein the air deflector (8) is arranged to be movable between a first position away from the point of contact (P) in which first position the air deflector (8) does not affect air entrained by the paper web (W) or the flexible belt (6) and a second position in which second position in which the air deflector (8) is so close to the point of contact (P) that flows of air entrained by at least one of the flexible belt (6) or the paper web (W) will be diverted away from the wedge-shaped space (WS).

4. A reel-up (3) according to claim 3, wherein the air deflector (8) carries at least one blade (9) which can be adjusted in relation to the air deflector (8) when the air deflector (8) is in its second position such that the blade (9) can be brought closer to the flexible belt (6) or the paper web (W).

5. A reel-up (3) according to claim 2, wherein the beam has a substantially triangular cross section.

6. A reel-up (3) according to claim 1, wherein:

the flexible belt (6) is air permeable; and at least one blow box (11) is arranged inside the loop of the flexible belt (6) between the point of contact (P) and the reel spool (5) such that an underpressure can be generated that draws the paper web (W) against the flexible belt (6).

7. A reel-up (3) according to claim 1, wherein:

the flexible belt (6) is air permeable and guided in its loop by guide rolls inside the loop of the flexible belt (6);

the reel spool (5) is arranged to engage the paper web (W) at a point between a guide roll located upstream of the reel spool (5) and a guide roll located downstream of the guide roll; and the upstream guide roll is a suction roll which is partially wrapped by the flexible belt.

8. A reel-up (3) according to claim 1, wherein the flexible belt (6) is air permeable and the reel-up also comprises a suction roll (10) which is located inside the loop of the flexible belt (6) at the point of contact (P) where the paper web meets the flexible belt, the suction roll (10) having a suction zone that acts both upstream and downstream of the point of contact (P).

9. A method of reeling a paper web on a reel-up according to claim 1, in which method air is diverted from the wedge-shaped space (WS) formed between the flexible belt (6) and the paper web (W) by means of the air deflector (8).

10. A method according to claim 9, which includes the step of moving the air deflector (8) from a first position away from the point of contact (P) to a second position in which the air deflector (8) is so close to the point of contact (P) that flows of air entrained by at least one of the flexible belt (6) or the paper web (W) will be diverted away from the wedge-shaped space (WS).

11. A method according to claim 9, wherein:

the flexible belt (6) is air permeable and air is also evacuated away from the wedge-shaped space (WS) by means of a suction roll (10) which is located inside the loop of the flexible belt (6) at the point of contact (P) where the paper web (W) meets the flexible belt (6); and the suction roll (10) has a suction zone that acts both upstream of and downstream of the point of contact (P).

* * * * *